US005505063A

United States Patent [19]

Kim et al.

[11] Patent Number: 5,505,063

[45] Date of Patent: Apr. 9, 1996

[54] LOW FREQUENCY VIBRATION TYPE WASHING MACHINE HAVING HORIZONTALLY VIBRATING DISK

[75] Inventors: Jung C. Kim, Seoul; Dong Y. Oh; Gyu S. Choe, both of Kyungki-do; Kyung S. Hong, Inchon-Jikhalsi; Kyung H. Kim, Seoul; Joo H. Lee, Kyungki-do; Ha I. Lee, Kyungki-do; Kyeong B. Park, Seoul; Dong S. Gil, Seoul; Oh H. Kwon, Seoul; Byoung H. Kwon, Busan-Jikhalsi, all of Rep. of Korea

[73] Assignee: Goldstar Co., Ltd., Seoul, Rep. of Korea

[21] Appl. No.: 255,872

[22] Filed: Jun. 8, 1994

[30] Foreign Application Priority Data

Jun. 9, 1993 [KR] Rep. of Korea ..... 10462/1993

[51] Int. Cl.[6] ..... D06F 19/00

[52] U.S. Cl. ..... 68/3 R; 68/355

[58] Field of Search ..... 68/355, 3 R, 131, 68/175; 134/1, 184, 186; 366/118, 127

[56] References Cited

U.S. PATENT DOCUMENTS

| | | | |
|---|---|---|---|
| 2,468,550 | 4/1949 | Fruth | 134/1 X |
| 2,554,701 | 5/1951 | Hackett et al. | 134/1 X |
| 2,985,003 | 5/1961 | Gelfand et al. | 68/3 SS |
| 3,002,731 | 10/1961 | Gelfand et al. | 366/118 |
| 3,240,963 | 3/1966 | Sasaki | 134/1 X |
| 3,371,233 | 2/1968 | Cook | 68/3 X |
| 4,727,734 | 3/1988 | Kanazawa et al. | 366/127 X |

FOREIGN PATENT DOCUMENTS

| | | | |
|---|---|---|---|
| 548960 | 10/1942 | United Kingdom | 68/3 SS |

*Primary Examiner*—Philip R. Coe

*Attorney, Agent, or Firm*—Finnegan, Henderson, Farabow, Garrett & Dunner

[57] ABSTRACT

A low frequency vibration type washing machine having at least one horizontally reciprocating disk is disclosed. The disk is provided on the side wall of the washing tub and horizontally vibrates in a direction perpendicular to the direction of gravity of the multi-phase washing medium, thus to generate the resonance phenomena in the washing medium inside the washing tub while saving disk drive energy. The multi-phase washing medium is made of water, detergent and air. The washing machine also includes an actuator which is coupled to the disk for driving this disk. In an embodiment, two disks are provided on the side wall of the washing tub in such a manner that they face each other. In this case, the disks may vibrate so as to form vibrational waves of the same phase or of different phases. The vibrational waves of the disks may have a phase difference larger than $-\pi/2$ and less than $\pi/2$.

1 Claim, 3 Drawing Sheets

LOW FREQUENCY VIBRATION TYPE WASHING MACHINE HAVING HORIZONTALLY VIBRATING DISK

BACKGROUND OF THE INVENTION

1. Field of the Invention

The present invention relates in general to automatic washing machines using low frequency vibration for washing clothes and, more particularly, to an improved structure in low frequency oscillating disks of such washing machines for generating of desired resonance phenomena in a multi-phase washing medium while saving energy.

2. Description of the Prior Art

In order to wash clothes in a conventional automatic washing machine using low frequency vibration, a low frequency oscillating disk placed in a washing tub generates a specified low frequency vibration which causes resonance phenomena in a multi-phase washing medium in the washing tub. Here, the multi-phase washing medium is made up of water, detergent and air. The level of low frequency is specified in accordance with the shape of the washing tub, shape of the oscillating disk and mixing ratio of the multi-phase washing medium.

In the above washing machine, the desired mechanical washing effect is achieved by the micro air bubbles generated by cavitation of the oscillating disk or nonlinear vibration. Both the cavitation and the nonlinear vibration are generated in the multi-phase medium at the same time as the generation of the resonance phenomena. The mechanical washing effect caused by the cavitation or the nonlinear vibration cooperates with a chemical washing effect caused by the detergent in the washing medium, thus to achieve the desired washing effect.

With reference to FIG. 1, there is shown a typical automatic washing machine using low frequency vibration. The washing machine generally comprises a washing tub 1, receiving multi-phase washing medium therein, and a low frequency oscillating disk 2 causing the resonance phenomena in the washing medium. The oscillating disk 2 is placed in the washing tub 1 and coupled to a disk drive actuator 3 through a shaft. The shaft transmits the drive force of the actuator 3 to the disk 2 so as to drive this disk 2.

There is provided a gap between the inner bottom of the washing tub 1 and the disk 2 for allowing the disk 2 to vertically vibrate.

In operation of the above washing machine, the low frequency oscillating disk 2 is driven by the actuator 3 in response to signals applied from an outside signal oscillator (not shown) to the actuator 3. This disk 2 thus oscillates in order to cause the resonance phenomena in the multi-phase washing medium in the washing tub 1. Here, the desired mechanical washing effect is achieved by the micro air bubbles generated by cavitation of the oscillating disk or nonlinear vibration, which cavitation and nonlinear vibration are generated in the multi-phase medium at the same time as the generation of the resonance phenomena. The above mechanical washing effect cooperates with the chemical washing effect caused by the detergent in the washing medium, thus to achieve the desired washing effect.

However, it has been noted that the above washing machine has a problem in that it uneconomically needs large amounts of energy due to the structure of its disk 2. That is, since the oscillating disk 2 is placed in the bottom of the washing tub 1 and vertically vibrates, it must be applied with hydrostatic pressure or gravitational pressure due to the weight of the washing medium when it ascends during its vertical vibration. In order to overcome the gravitational pressure, the disk 2 must use a large amount of energy in its vibration. Particularly, the disk 2 is applied with overload as it starts, so that it uses a large amount of start energy. The necessity for a large amount of energy in driving the disk 2 directly runs counter to the recent trend to save energy.

SUMMARY OF THE INVENTION

It is, therefore, an object of the present invention to provide a low frequency vibration type washing machine in which the aforementioned problem of the conventional washing machine can be overcome and which has at least one horizontally reciprocating disk provided on the side wall of a washing tub and generating the desired resonance phenomena in the multi-phase washing medium while saving disk drive energy.

In order to accomplish the above object, a low frequency vibration type washing machine in accordance with an embodiment of the present invention comprises: a washing tub receiving a multi-phase washing medium therein, the multi-phase washing medium being made up of water, detergent and air; disk means provided on the side wall of the washing tub and horizontally vibrating in a direction perpendicular to the direction of gravity of the washing medium, thus to generate resonance phenomena in the washing medium; and an actuator coupled to the disk means for driving the disk means.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
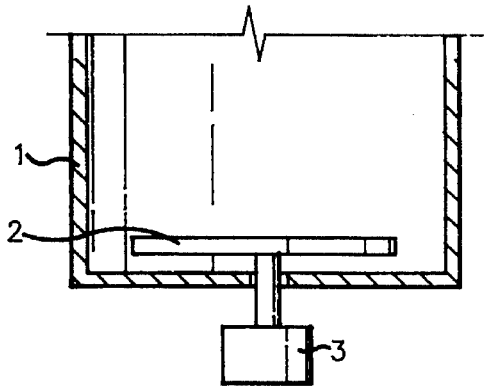
FIG. 1 PRIOR ART
FIG. 1 is a sectional view of a typical washing machine using low frequency vibration in its washing operation.

In the following description, those elements common to both the embodiments of this invention and the prior art embodiment of FIG. 1 will carry the same reference numerals.

Figure 2:
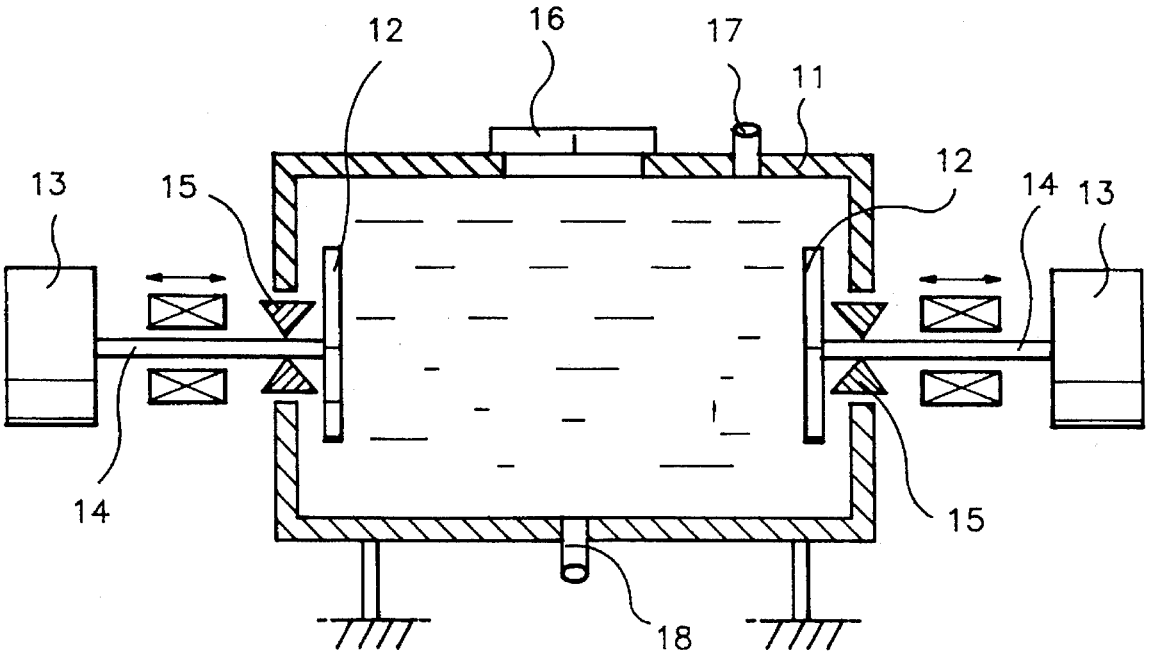
FIG. 2 is a sectional view of a low frequency vibration type washing machine having two horizontally reciprocating disks on the side wall of its washing tub in accordance with a primary embodiment of the present invention.

With reference to FIG. 2, there is shown a low frequency vibration type washing machine in accordance with a primary embodiment of the present invention. The washing machine includes a washing tub 11 for receiving therein multi-phase washing medium, which medium is made of water, detergent and air. The washing tub 11 includes disk means on its side wall. The disk means horizontally reciprocates or vibrates in a direction perpendicular to the direction of gravity of the washing medium, thus to generate resonance phenomena in the washing medium. In the primary embodiment, the disk means comprises a pair of horizontally reciprocating disks or horizontally vibrating disks 12, that is, a left disk and a right disk, provided on the side wall of the washing tub 11 in such a manner that the disks 12 face each other. Each disk 12, which horizontally reciprocates and causes the resonance phenomena in the washing medium, is coupled to a disk drive actuator 13 through a shaft 14. The shaft 14 transmits the drive force of the actuator 13 to the disk 12 so as to drive this disk 12.

A lid 16 and a water inlet 17 are provided on the top of the washing tub 11. Since the shafts 14 of the disks 12 penetrate the side wall of the washing tub 11 such that they horizontally reciprocate along with the disks 12, the washing tub 11 should be sealed at its shaft holes at which the tub 11 receives the shafts 14. This object is achieved by seals 15 fitted in the shaft holes of the washing tub 11. The bottom of the washing tub 11 is provided with a drain port 18 for draining the waste washing medium to the outside.

There is provided a gap between the side wall of the washing tub 11 and each disk 12 so as to allow the disk 12 to horizontally vibrate.

In operation of the above washing machine, the disks 12 are driven by their actuators 13 in response to signals applied from an outside signal oscillator (not shown) to the actuators 13. These disks 12 thus horizontally reciprocate in the direction perpendicular to the direction of gravity of the washing medium and of the clothes and cause the resonance phenomena in the multi-phase washing medium inside the washing tub 11.

At this time, since the washing machine of the primary embodiment has two disks 12 which are driven by their actuators 13, the vibrational force applied to the washing medium in the tub 11 is doubled in comparison with a washing machine having one disk. As described above, the disks 12 horizontally reciprocate or horizontally vibrate in the direction perpendicular to the direction of gravity of the washing medium, so that they are applied with little gravitational pressure of the washing medium. In this regard, the disk drive actuators 13 can drive their disks 12 using a small amount of energy and cause the desired resonance phenomena in the washing medium.

At the same time as the generation of the resonance phenomena, the mechanical washing effect is caused in the washing tub 11 by the cavitation the micro air bubbles or by the nonlinear vibration of the washing medium. This mechanical washing effect cooperates with the chemical washing effect caused by the detergent in the washing medium, thus to achieve the desired washing effect.

Of course, the water of the washing medium should be supplied to the washing tub 11 through the water inlet 17 before washing the clothes. During the washing operation, the seals 15 fitted in the shaft holes of the washing tub 11 reliably prevent leakage of the washing medium through the shaft holes. After the washing operation, the waste washing medium is drained from the washing tub 11 to the outside through the drain port 18 of the bottom of washing tub 11.

Since the disk drive actuators 13 are applied with little load when driving their disks 12, it is preferred to provide at least two disks 12 for the washing tub 11. In this case, the vibrational force will be maximized.

Figure 3A:
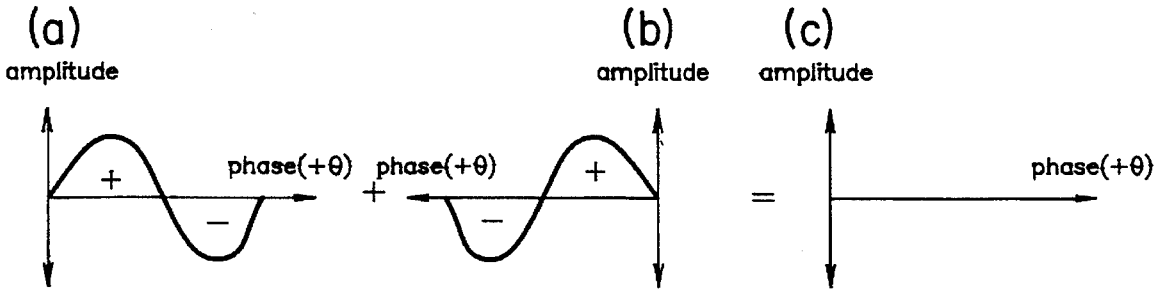
FIGS. 3A to 3C are waveform diagrams representing the vibrational phases of the left and right disks of the washing machine of FIG. 2.
Figure 3B:
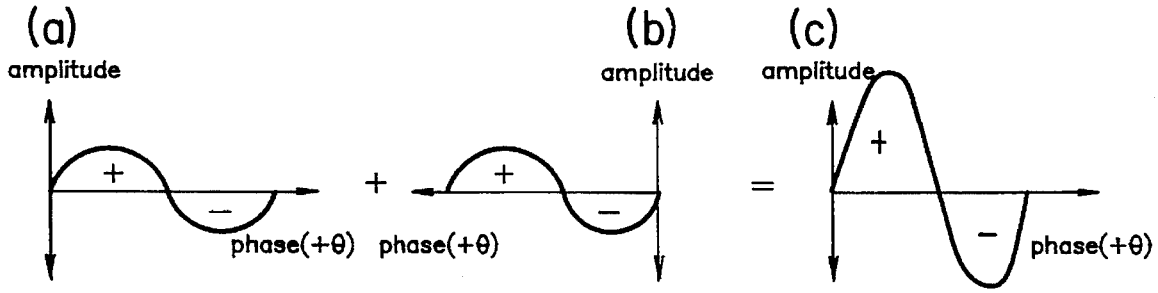
Figure 3C:
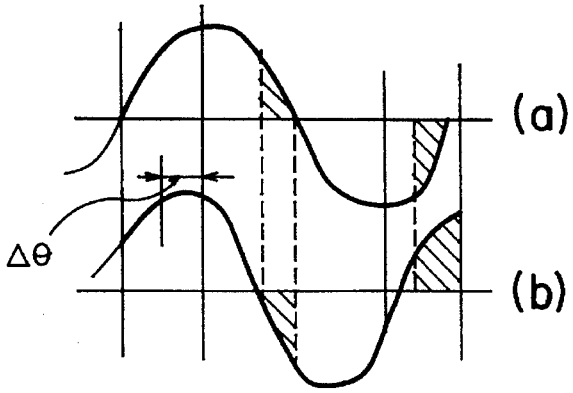

Turning to FIGS. 3A to 3C, there are shown waveform diagrams representing vibrational phases of the left and right disks 12 of the washing tub 11.

As represented in FIG. 3A, when the two disks 12 simultaneously vibrate so as to generate their vibrational waves having the same phase and propagating in the washing medium in opposed directions, the waves interfere with each other so as to be offset by each other. In this case, the inertial forces of the disks 12 are opposed to each other in their directions. The washing tub 11 is thus scarcely vibrated.

However, when the two disks 12 simultaneously vibrate so as to generate their vibrational waves having different phases and propagating in the washing medium in opposed directions as shown in FIG. 3B, the waves interfere with each other so as to form the composed wave of FIG. 3B. In this case, the inertial forces of the disks 12 are in the same direction. The maximum exciting force is thus applied from the disks 12 to the washing medium.

When there is a phase difference of $\Delta\Theta$, $-\pi/2<\Delta\Theta<\pi/2$, between the vibrational waves of the two disks 12 as represented in FIG. 3C, the vibrating disks 12 result in the same effect as described for the case of FIG. 3A at the phases of the same polarity. However, the vibrating disks 12 result in the same effect as described for the case of FIG. 3B at the phases of the different polarities (crossed sections of FIG. 3C). When there is the phase difference $\Delta\Theta$ between the vibrational waves of the disks 12, the vibration restricting effect of FIG. 3A and the exciting force increasing effect of FIG. 3B thus alternately appear. Therefore, an effective resonance phenomena is generated in the washing medium with negligible vibration of the washing tub 11.

Figure 4A:
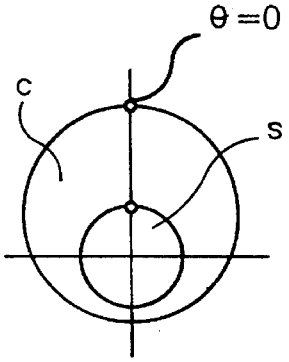
FIGS. 4A and 4B are a schematic views representing the theory for both the phase control of the disks and vibrating the disks using their cams.
Figure 4B:
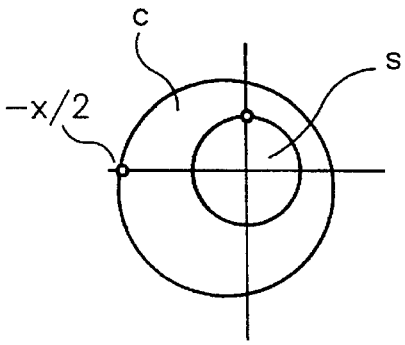

FIG. 4 is a schematic view representing the theory for both the phase control of disks 12 and vibrating the disks 12 using their respective cams. In order to control the phases of the disks 12 and to vibrate the disks 12, a cam "c" is provided on a shaft "s" of each actuator 13. With the cam "c" the rotational motion of the shaft "s" is converted into the rectilinear reciprocating motion of the disk 12. In the above embodiment of FIG. 4, one of the right and left disks 12 starts its vibration at −90° angle while the other disk 12 starts its vibration at 0° angle. However, it should be understood that the phase difference $\Delta\Theta$ between the vibrational waves of the two disks 12 may be controlled within the range from $-\pi/2$ (−90° ) to $\pi/2$ (90° ) by appropriately adjusting the cam "c".

Figure 5:
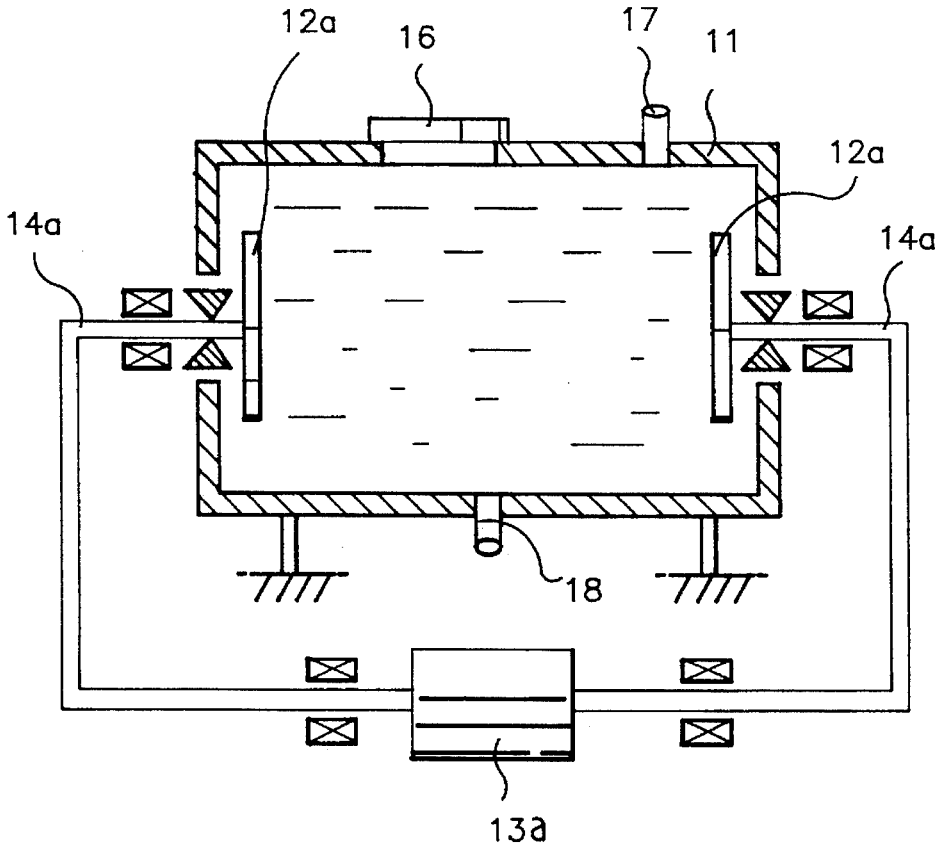
FIG. 5 is a view corresponding to FIG. 2, but showing a second embodiment of the present invention.

FIG. 5 shows a low frequency vibration type washing machine in accordance with a second embodiment of the present invention. In this second embodiment, the shafts 14*a* of two horizontally reciprocating disks 12*a* are commonly coupled to an actuator 13*a* unlike the primary embodiment. In this washing machine, the two disks 12 are thus driven by the common actuator 13*a*. The other elements of this second embodiment are common with those of the primary embodiment and further explanation is thus not deemed necessary.

Figure 6:
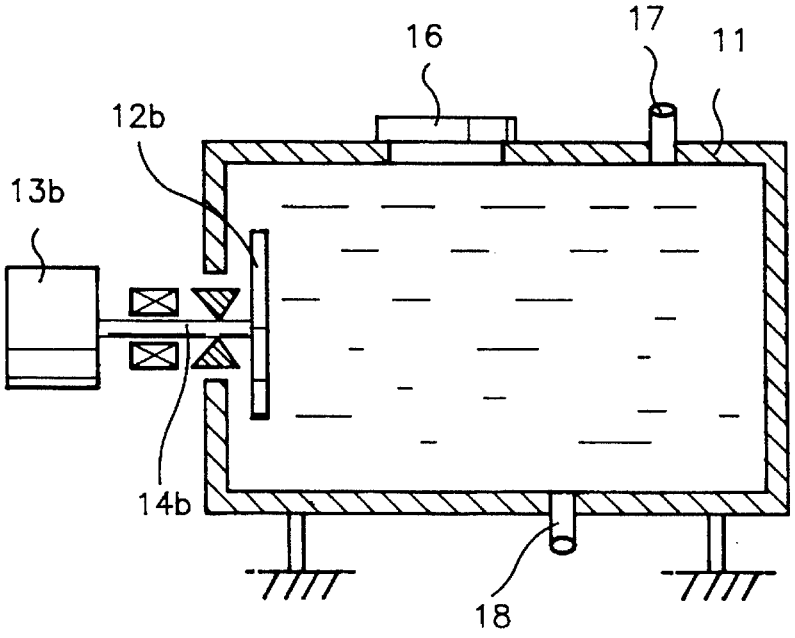
FIG. 6 is a view corresponding to FIG. 2, but showing a third embodiment of the present invention.

Turning to FIG. 6, there is shown a low frequency vibration type washing machine in accordance with a third embodiment of the present invention. Unlike the primary and second embodiments, this washing machine is provided with only one horizontally reciprocating disk 12*b* provided on either side of the washing tub 11. In comparison with the conventional low frequency vibration type washing machine having the vertically vibrating disk, the washing machine of FIG. 6 reduces the load applied on the disk 12*b* and saves energy for driving the disk 12*b*.

As described above, a low frequency vibration type washing machine in accordance with the present invention has at least one horizontally reciprocating disk which is provided on the side wall of a washing tub and generates the desired resonance phenomena in the multi-phase washing medium while saving disk drive energy. Since the disks horizontally reciprocate in a direction perpendicular to the direction of gravity of the washing medium, they are applied with little load thereon. The disk drive actuators thus drive the disks with consumption of a small amount of energy. Particularly when the disks start their horizontal reciprocating motions, the disks are applied with small load. In this regard, the starting of disks is achieved using a small amount of start energy. The fact that the disk drive actuators drive their disks using such a small amount of energy achieves the recent trend of energy saving.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A low frequency vibration type washing machine comprising:

a washing tub for receiving clothes and a multi-phase washing medium therein, said multi-phase washing medium including water, detergent and air;

disk means mounted on a side wall of said washing tub for horizontal vibration perpendicular to a force of gravity of said washing medium, thus to reduce weight of said clothes and multi-phase washing medium on said disk means; and an actuator coupled to said disk means for driving the disk means at a low frequency of vibration to generate a resonance phenomena in the washing medium, wherein said disk means comprises a pair of horizontally vibrating disks, said disks being provided on the side wall of the washing tub in such a manner that they face each other and said disks generate vibrational waves having a phase difference larger than $-\pi/2$ and less than $\pi/2$.

* * * * *